US009896287B2

(12) United States Patent
Dahlqvist

(10) Patent No.: US 9,896,287 B2
(45) Date of Patent: Feb. 20, 2018

(54) DEVICE FOR FEEDING PAPERS

(71) Applicant: PLOCKMATIC INTERNATIONAL AB, Hägersten (SE)

(72) Inventor: Patrik Dahlqvist, Täby (SE)

(73) Assignee: PLOCKMATIC INTERNATIONAL AB, Hagersten (SE)

( * ) Notice: Subject to any disclaimer, the term of this patent is extended or adjusted under 35 U.S.C. 154(b) by 0 days.

(21) Appl. No.: 15/273,734

(22) PCT Filed: Mar. 23, 2015

(86) PCT No.: PCT/SE2015/050345
§ 371 (c)(1),
(2) Date: Sep. 23, 2016

(87) PCT Pub. No.: WO2015/147732
PCT Pub. Date: Oct. 1, 2015

(65) Prior Publication Data

US 2017/0029225 A1 Feb. 2, 2017

(30) Foreign Application Priority Data

Mar. 24, 2014 (SE) ..... 1450339

(51) Int. Cl.
*B65H 3/06* (2006.01)
*B65H 1/14* (2006.01)

(52) U.S. Cl.
CPC ..... *B65H 3/0669* (2013.01); *B65H 1/14* (2013.01); *B65H 2403/21* (2013.01);
(Continued)

(58) Field of Classification Search
CPC ..... B65H 1/14; B65H 3/0669; B65H 3/0684; B65H 2404/1521; B65H 2404/133;
(Continued)

(56) References Cited

U.S. PATENT DOCUMENTS 3,525,517 A * 8/1970 Toby ..... B65H 3/06 271/117
5,848,786 A * 12/1998 Holland-Letz ..... B65H 1/025 271/110

(Continued)

FOREIGN PATENT DOCUMENTS

JP 0648594 A 2/1994
JP 06048594 A * 2/1994

*Primary Examiner* — Patrick Cicchino
(74) *Attorney, Agent, or Firm* — Moser Taboada

(57) ABSTRACT

A paper feeding device comprises a storage surface for a stack of papers and being adapted to be move vertically between a first, lower end position and a second, upper end position, and a feeding roll for feeding papers from their position on the storage surface and imparting an uppermost sheet of paper a horizontal displacement. A first mounting device comprises a first vertically movable, preferably pivotable housing adapted to mount or suspend a first end of the feeding roll, and a second mounting device comprises a second vertically movable, preferably pivotable housing adapted to mount or suspend a second end of the feeding roll opposite to the first end of the feeding roll. By providing the first and second housings pivotable independently of each other and an intermediate axle, the feeding roll adapts to a non-uniform stack of papers, improving the reliability of the feeding.

4 Claims, 4 Drawing Sheets

(52) U.S. Cl.
CPC .. *B65H 2404/122* (2013.01); *B65H 2404/133* (2013.01); *B65H 2404/1526* (2013.01)

(58) Field of Classification Search
CPC ..... B65H 2404/122; B65H 2404/1526; B65H 2403/4433; B65H 2403/21
See application file for complete search history.

(56) References Cited

U.S. PATENT DOCUMENTS

| | | | | |
|---|---|---|---|---|
| 7,410,159 | B2 * | 8/2008 | Miyazaki | B65H 1/14 271/110 |
| 8,523,173 | B2 * | 9/2013 | Hayayumi | B65H 1/266 271/117 |
| 2007/0007709 | A1 | 1/2007 | Miyazaki et al. | |
| 2007/0069456 | A1 * | 3/2007 | Jeong | B65H 5/062 271/272 |
| 2010/0276873 | A1 * | 11/2010 | Richards | B65H 9/006 271/234 |

* cited by examiner

DEVICE FOR FEEDING PAPERS

This application is the national stage entry of International Application No. PCT/SE2015/050345, filed 23 Mar. 2015, which claims the benefit of Swedish Patent Application No. SE 1450339-5, filed 24 Mar. 2014, the entire contents of which are hereby incorporated by reference.

TECHNICAL FIELD

The present invention relates generally to a device for feeding sheets of paper in a feeder or sorter, and more particularly to a device with an improved feeding roll arrangement.

BACKGROUND ART

There are essentially two types of feeders for use for after-treatment of sheets of paper in printing machines and copiers, viz. friction feeders and vacuum feeders. In friction feeding devices or feeders, individual sheets are picked from piles of sheets by the fact that a rotary feeding roll is abutted against and pulls the top sheet from the pile, wherein a subjacent separations or friction block normally retains subjacent sheets of the pile. Friction feeders are robust and in general reliable in operation, but occasionally more than one sheet at a time may happen to be picked mistakenly. The feeding rolls may also leave marks in the sheets. In vacuum feeders, sheets are picked from piles by the fact that the top sheet of the pile is sucked against a conveyor belt for transportation of the sheet to subsequent further processing. The vacuum feeder has not the disadvantages mentioned above of the friction feeder, but the function thereof is more sensitive and a vacuum feeder is considerably more expensive than a friction feeder.

A problem in friction feeding devices or friction feeders is to pull the uppermost sheet of paper in a straight direction, since the height of the stack of papers may not be uniform across the stack. This is the case when one side area of the stack of papers is higher than the opposite side area. This can be due to the printing process used giving the sheets of paper a wave shape or for other reasons.

SUMMARY OF INVENTION

An object of the present invention is to overcome the problems in prior art with non-uniform stacks of paper in friction feeding devices and to provide a friction feeding device with improved reliability.

The invention is based on the realization that the feeding roll can be individually suspended or mounted in the two opposite ends thereof, allowing an adjustment of the position of the feeding roll relatively to the stack of papers.

According to the invention there is thus provided a paper feeding device comprising: a storage surface for a stack of papers and being adapted to be moved vertically between a first, lower end position and a second, upper end position, a feeding roll for feeding papers from their position on the storage surface and imparting an uppermost sheet of paper a horizontal displacement, the paper feeding device being characterized by a first mounting device comprising a first vertically movable housing adapted to mount or suspend a first end of the feeding roll, and a second mounting device comprising a second vertically movable housing adapted to mount or suspend a second end of the feeding roll opposite to the first end of the feeding roll, wherein the first and second housings are pivotable independently of each other, a driving axle which is rotationally driven by means of a motor arrangement, wherein the driving axle is adapted to impart a rotation to the feeding roll via an intermediate axle, which is rotationally journalled in the first housing and provided at a distance from the driving axle, and a toothed belt provided between a toothed first end portion of the driving axle and a toothed portion of the intermediate axle, which is characterized in that the feeding roll is adapted to be brought to rotate together with the intermediate axle while the longitudinal directions of the feeding roll and the intermediate axle may differ, allowing some flexibility of the orientation of the feeding roll relatively to the first mounting device.

In a preferred embodiment, the paper feeding device comprises a first spring extending between the first housing and a first fixed fastening point below the first housing and a second spring extending between the second housing and a second fixed fastening point below the second housing, wherein the first spring and the second spring are adapted to exert a force downward on the feeding roll. Thereby, a pressure on the upper side of the uppermost sheet of paper is ensured.

In a preferred embodiment, the second housing is provided with a hole adapted to receive a second end of the feeding roll, wherein the hole preferably has a depth and diameter allowing some flexibility in the position of the feeding roll relatively to the second housing.

In a preferred embodiment, the first housing exhibits an extension which is adapted to provide a fixed sensor with information of the orientation of the first housing.

A paper processing machine comprising a paper feeding device according to the invention is also provided.

BRIEF DESCRIPTION OF DRAWINGS

The invention is now described, by way of example, with reference to the accompanying drawings, in which.

DESCRIPTION OF EMBODIMENTS

In the following, a detailed description of a paper feeding device according to the invention will be given. Special references given in the description, such as "up" or "down", refer to directions during normal operation of the device.

Figure 1A:
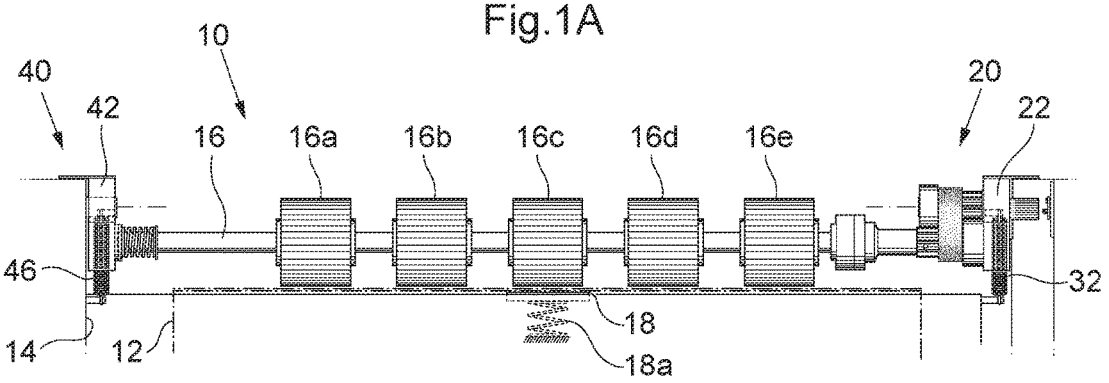
FIGS. 1A-C show a side view of a feeding roll arrangement comprised in a paper feeding device according to the invention.
Figure 1B:
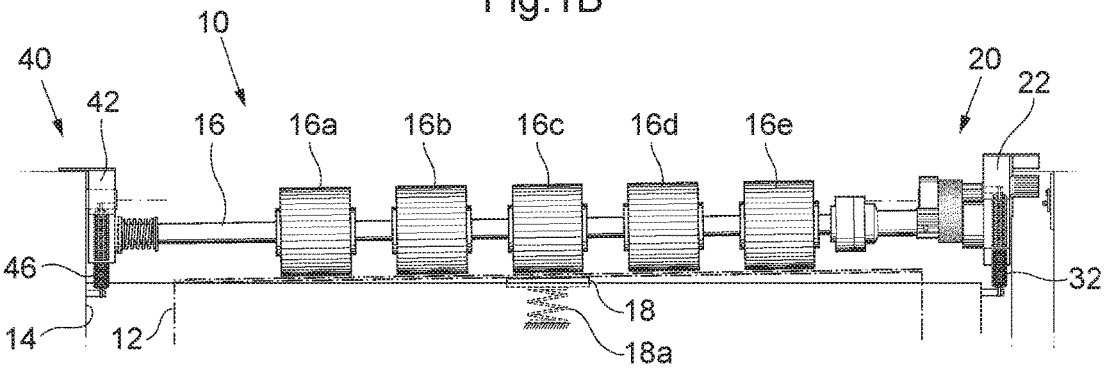
Figure 1C:
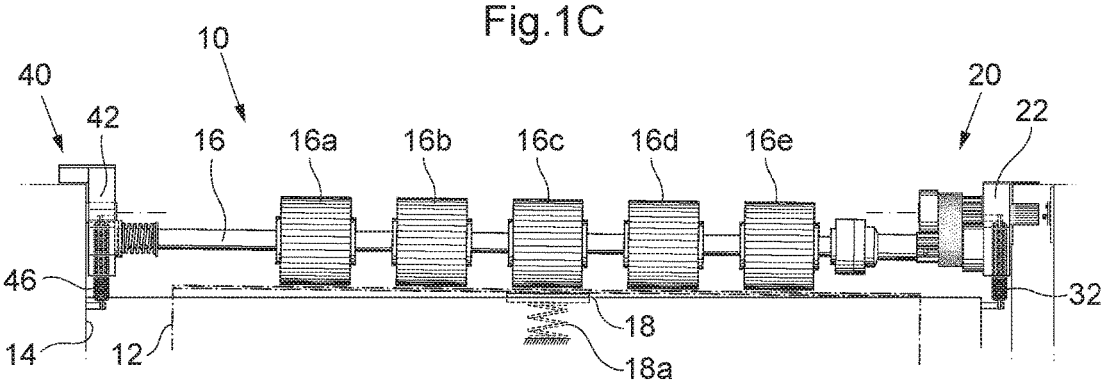
Figure 2:
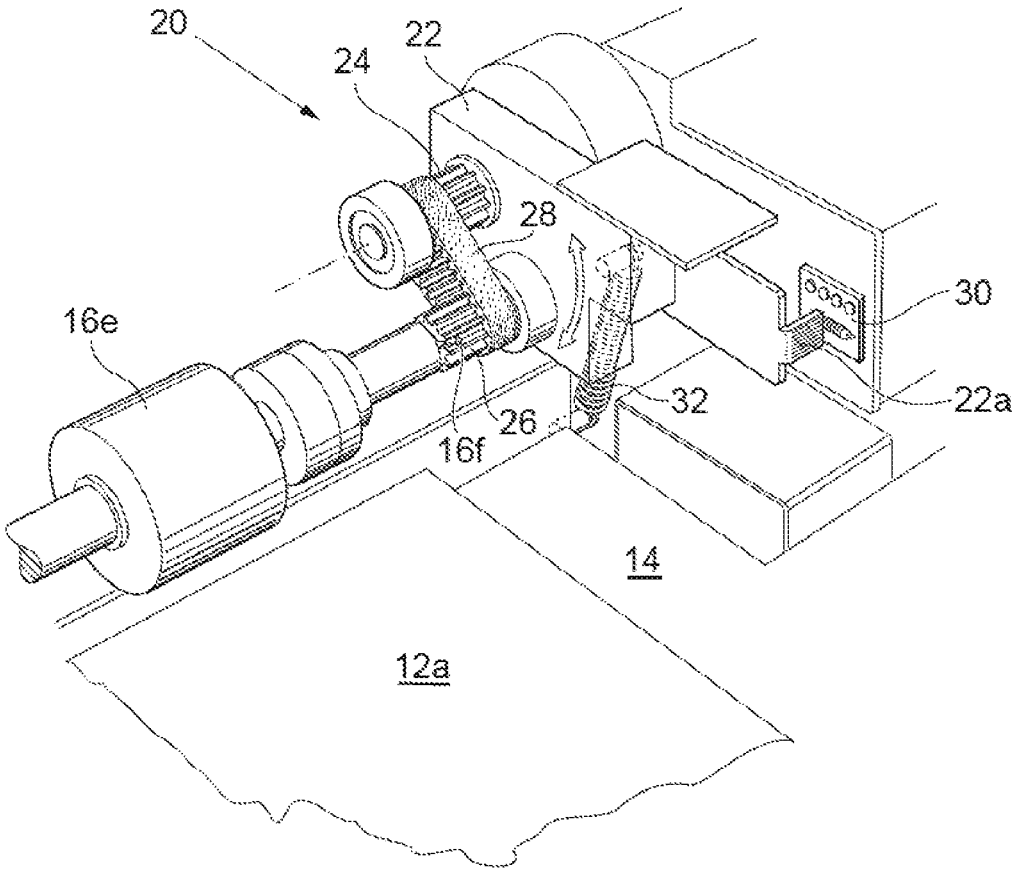
FIG. 2 is a perspective view of a first mounting device for the feeding roll shown in FIGS. 1A-C.

Reference is first made to FIGS. 1A-C wherein a side view of the upper portion of a paper feeding device, generally designated 10, is shown. A stack of papers 12, indicated with dashed lines in FIGS. 1A-C, is provided on a storage surface (See FIG. 2) in the form of a mechanical elevator adapted to be moved vertically between a first, lower end position and a second, upper end position. In this context, the term "stack of papers" should be interpreted as at least two papers, but usually the stack of papers comprises a much higher number of sheets. A feeding roll 16 extends across essentially the entire width of the stack of papers 12 and comprises in the shown embodiment five sub-rolls 16*a-e*. The feeding roll is provided for the feeding of papers from their position on the storage surface and imparts the uppermost sheet of paper 12*a* a horizontal displacement, passing below the feeding roll 16.

The paper feeding device 10 is also provided with a friction or separations block 18 which is spring biased upward by means of a separations block spring 18*a* and is adapted to provide friction to ensure that only a single sheet of paper is fed by the feeding roll at each time.

The paper feeding device 10 further comprises a first mounting device 20 adapted to mount or suspend a first end of the feeding roll 16. The first mounting device is shown in more detail in FIG. 2 and comprises a first pivotable part or housing 22 which is rotationally connected by means of a horizontal shaft (not shown) to a mounting part, which is fixed in relation to the machine in which the paper feeding device is provided. This means that the pivotable housing 22 can pivot in the direction indicated by the double headed arrow in FIG. 2.

Figure 3:
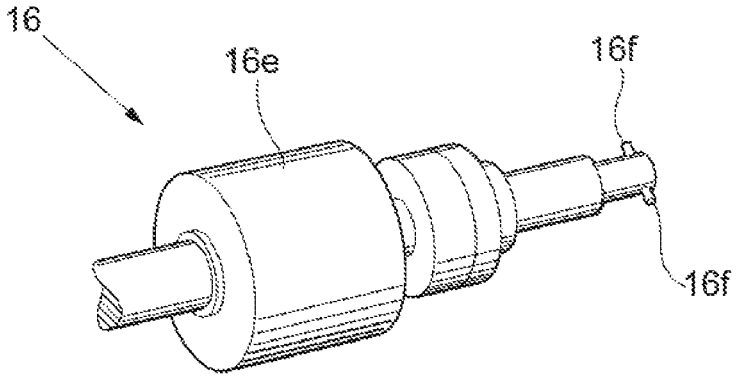
FIG. 3 shows in detail the end of the feeding roll mounted to the first mounting device shown in FIG. 2.

A driving axle with a toothed end portion 24 extends through the first pivotable housing 22. The driving axle is rotationally driven by means of a motor arrangement (not shown). The end potion 24 is adapted to impart a rotation to the feeding roll 16 via a toothed intermediate axle 26 rotationally journalled in the first housing 22 and provided at a distance from the driving axle. To this end, a toothed belt 28 is provided between the toothed first end portion 24 of the driving axle and the toothed intermediate axle 26. The outer end portion of the intermediate axle is provided with two recesses adapted to receive a respective radial pin 16*f* provided at the outer end portion of the feeding roll, see also FIG. 3. With this arrangement, the feeding roll 16 is brought to rotate together with the intermediate axle 26 while the longitudinal direction of the feeding roll 16 and the intermediate axle 26 may differ, allowing some flexibility of the orientation of the feeding roll 16 relatively to the first mounting device 20.

The first housing 22 exhibits an extension 22*a* which is adapted to provide a fixed sensor 30 with information of the orientation of the first housing 22. This information is used for determining when the stack of papers has been lifted to an operation position in which the uppermost sheet of paper abuts the sub-rolls 16*a-e* of the feeding roll 16.

A first spring 32 extends between the first housing 22 and a fixed fastening point below the first housing.

Figure 4:
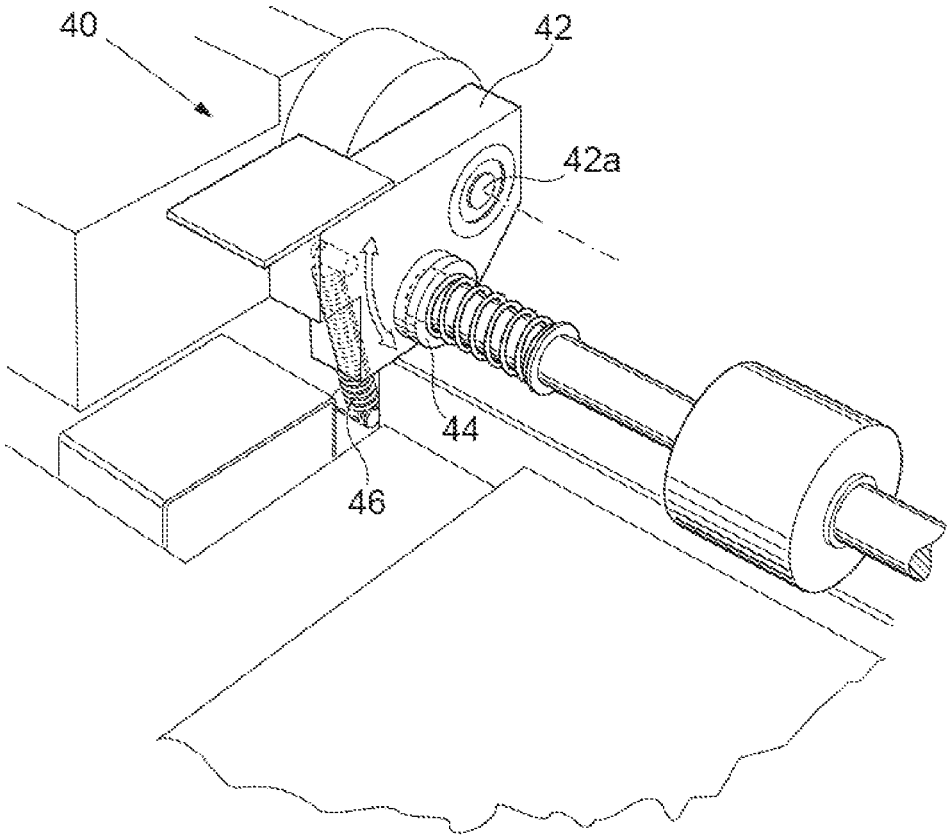
FIG. 4 is a perspective view of a second mounting device for the feeding roll shown in FIGS. 1A-C.

The paper feeding device 10 further comprises a second mounting device 40 adapted to mount or suspend a second end of the feeding roll 16 opposite to the first end thereof. The second mounting device is shown in more detail in FIG. 4 and comprises a second pivotable part or housing 42 which is rotationally connected by means of a horizontal shaft 42*a* to a mounting part, which is fixed in relation to the machine in which the paper feeding device is provided. This means that the pivotable housing 42 can pivot in the direction indicated by the double headed arrow in FIG. 4. It will be appreciated that the first and second housings are pivotable independently of each other, allowing the feeding roll 16 to take positions deviating from horizontal.

The second housing 42 is provided with a hole 44 adapted to receive the second end of the feeding roll 16. This hole 44 preferably has a depth and diameter allowing some flexibility in the position of the feeding roll 16 relatively to the second housing 42.

A second spring 46 extends between the second housing 42 and a fixed fastening point below the second housing. This second spring 46 and the first spring 32 are together adapted to exert a force downward on the feeding roll 16. This downward force must overcome the upward force provided by the separations block spring 18*a*.

Figure 5:
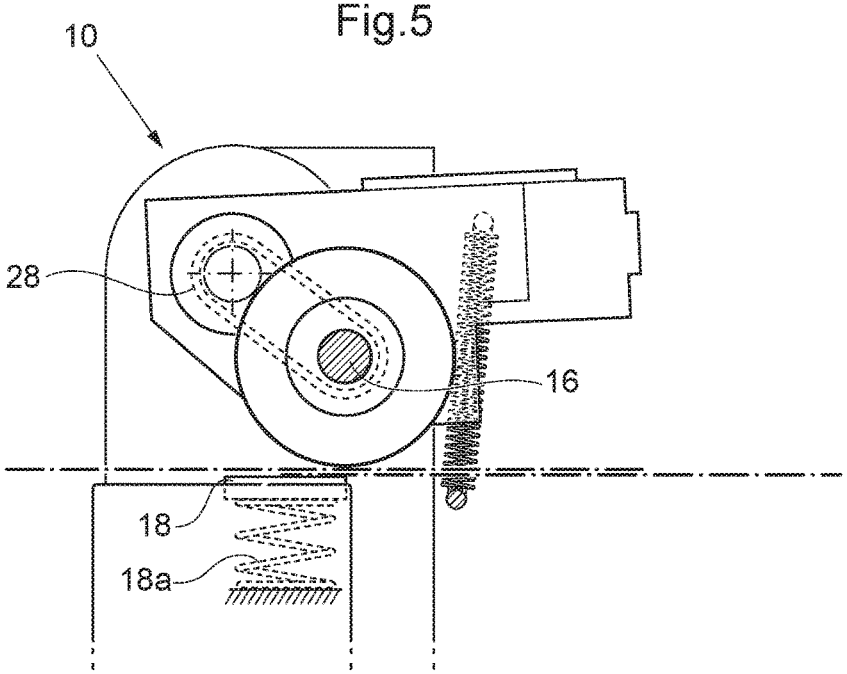
FIG. 5 is an end view, partially in section, of the feeding roll arrangement shown in FIG. 1A-C.

A partly cross-sectional view of the feeding roll portion of the paper feeding device is shown in FIG. 5.

The paper feeding device may optionally comprise a fan arrangement (not shown) in the form of pairs of fans to provide a flow of air separating the uppermost sheet of paper 12*a* from the rest of the stack, whereby the problem with electrostatic charging of the papers is decreased.

The paper feeding device may optionally comprise a second sensor (not shown) provided above the stack of papers and adapted and arranged to measure an actual vertical position of the uppermost sheet of paper.

The function of the feeding roll arrangement will now be described with reference to FIGS. 1A-C. In FIG. 1A the feeding roll arrangement comprising the feeding roll 16, the first mounting device 20 and the second mounting device 40 is shown during operation with an essentially uniform stack of papers. This means that the feeding roll 16 extends essentially horizontally across the width of the stack of papers 12. The sub-rolls 16*a-e* press against the uppermost sheet of paper by means of the spring force exerted by the springs of the first and second mounting devices 20, 40. Due to the independent movement or pivoting of the first and second houses, the feeding roll 16 presses across the entire width of the uppermost sheet of paper, resulting in a straight feeding of this paper.

FIG. 1B shows an example wherein the stack of papers 12 is non-uniform. It can be seen that the right portion of the stack of papers as seen in the figure is higher than the left portion. In a prior art paper feeding device this would result in a lower pressure or engagement by the leftmost sub-rolls 16*a* and 16*b* against the upper surface of the uppermost sheet of paper. However, since the first and second pivotable housings 22, 42 of the first and second mounting devices, respectively, are individually pivotable, the feeding roll 16 adapts the direction of its extension to the non-uniform stack of paper. In other words, the spring 46 of the second or left mounting device 40 pulls the pivotable second housing 42 downward to a larger extent than the spring 32 of the first or right mounting device 20 pulls the pivotable first housing 22 downward. Due to the tilting or non-horizontal orientation of the feeding roll 16, an even pressure will be exerted by the five sub-rolls 16*a-e* and the uppermost sheet of paper will be pulled in a straight direction by the feeding roll arrangement.

FIG. 1C shows another example wherein the stack of papers 12 is non-uniform. It can be seen that the left portion of the stack of papers as seen in the figure is higher than the right portion. In this case, the spring 32 of the first or right mounting device 20 pulls the pivotable first housing 22 downward to a larger extent than the spring 46 of the second or left mounting device 40 pulls the pivotable second housing 42 downward, resulting in an even pressure being exerted by the five sub-rolls 16*a-e* and the uppermost sheet of paper will be pulled in a straight direction by the feeding roll arrangement.

Figure 6:
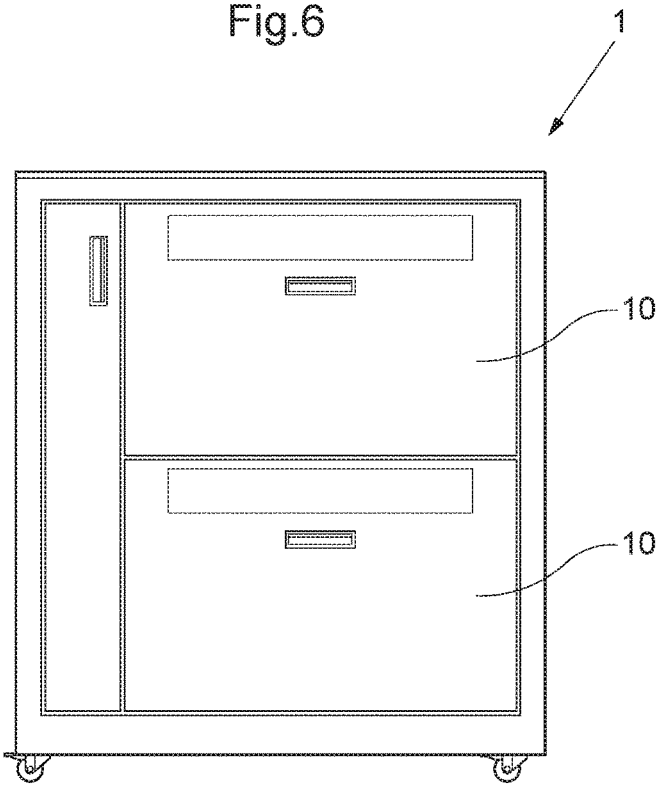
FIG. 6 is a side view of a feeder provided with two paper feeding devices according to the invention.

In FIG. 6 a paper processing machine 1 is shown, which is provided with two paper feeding devices 10 according to the invention.

A preferred embodiment of a paper feeding device has been described. It will be appreciated that this can be modified without departing from the inventive idea as defined by the appended claims. Thus, although pivoting housings have been described and shown, it will be appreciated that also other ways of displacement or movement are possible, as long as the housings are vertically movable to adjust the direction of the feeding roll.

The paper feeding device has been described as part of a paper processing machine comprising two paper feeding devices. It will be appreciated that the inventive paper feeding device may be provided in any kind of machine adapted to process sheets of paper, such as paper collators and cover feeders.

The transfer of the rotational movement of the driving axle has been described involving a toothed belt and an intermediate axle. It will be appreciated that the feeding roll can be rotated in other ways as well, such as by transfer of the movement by means of a chain or by means of direct driving of the feeding roll without any intermediate axle.

The invention claimed is:

1. A paper feeding device comprising:

a storage surface for a stack of papers and being adapted to be moved vertically between a first, lower end position and a second, upper end position, a feeding roll for feeding papers from their position on the storage surface and imparting an uppermost sheet of paper a horizontal displacement, a first mounting device comprising a first vertically movable housing adapted to mount or suspend a first end of the feeding roll, a second mounting device comprising a second vertically movable housing adapted to mount or suspend a second end of the feeding roll opposite to the first end of the feeding roll, wherein the first and second housings are pivotable independently of each other, a driving axle which is rotationally driven by means of a motor arrangement, wherein the driving axle is adapted to impart a rotation to the feeding roll via an intermediate axle, which is rotationally journalled in the first housing and provided at a distance from the driving axle, and a toothed belt provided between a toothed first end of the driving axle and a toothed portion of the intermediate axle, wherein the feeding roll is adapted to be brought to rotate together with the intermediate axle while the longitudinal directions of the feeding roll and the intermediate axle may differ, allowing some flexibility of the orientation of the feeding roll relatively to the first mounting device the paper feeding device further comprising a first spring extending between the first housing and a first fixed fastening point below the first housing and a second spring extending between the second housing and a second fixed fastening point below the second housing, wherein the first spring and the second spring are adapted to exert a force downward on the feeding roll.

2. The paper feeding device according to claim 1, wherein the second housing is provided with a hole adapted to receive a second end of the feeding roll, wherein the hole preferably has a depth and diameter allowing some flexibility in the position of the feeding roll relatively to the second housing.

3. The paper feeding device according to claim 1, wherein the first housing exhibits an extension which is adapted to provide a fixed sensor with information of the orientation of the first housing.

4. A paper processing machine comprising a paper feeding device according to claim 1.

* * * * *